US011276519B2

(12) United States Patent
Shinohara et al.

(10) Patent No.: US 11,276,519 B2
(45) Date of Patent: Mar. 15, 2022

(54) COIL COMPONENT

(71) Applicant: Murata Manufacturing Co., Ltd., Kyoto-fu (JP)

(72) Inventors: Gota Shinohara, Nagaokakyo (JP); Noriko Shimizu, Nagaokakyo (JP); Keiichi Ishida, Nagaokakyo (JP); Hironobu Kubota, Nagaokakyo (JP); Mari Yonemura, Nagaokakyo (JP); Takao Kawachi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 694 days.

(21) Appl. No.: 16/180,943

(22) Filed: Nov. 5, 2018

(65) Prior Publication Data

US 2019/0180909 A1 Jun. 13, 2019

(30) Foreign Application Priority Data

Dec. 13, 2017 (JP) ..... JP2017-238859

(51) Int. Cl.
*H01F 27/22* (2006.01)
*H01F 27/32* (2006.01)
(Continued)

(52) U.S. Cl.
CPC ..... *H01F 27/22* (2013.01); *H01F 3/10* (2013.01); *H01F 17/0013* (2013.01);
(Continued)

(58) Field of Classification Search
CPC ..... H01F 27/22; H01F 3/10; H01F 17/0013; H01F 27/327; H01F 27/292;
(Continued)

(56) References Cited

U.S. PATENT DOCUMENTS 6,661,328 B2 * 12/2003 Inoue ..... H01F 41/0246 336/233
9,536,660 B2 * 1/2017 Park ..... H01F 41/046
(Continued)

FOREIGN PATENT DOCUMENTS

JP 2002-305108 A 10/2002
JP 2002-313632 A 10/2002
(Continued)

OTHER PUBLICATIONS

An Office Action; "Notification of Reasons for Refusal," issued by the Japanese Patent Office dated Feb. 12, 2020, which corresponds to Japanese Patent Application No. 2017-238859 and is related to U.S. Appl. No. 16/180,943; with English language translation.
(Continued)

*Primary Examiner* — Tuyen T Nguyen
(74) *Attorney, Agent, or Firm* — Studebaker & Brackett PC

(57) ABSTRACT

A coil component including an element assembly and a coil conductor embedded in the element assembly. The element assembly includes a first magnetic layer and a second magnetic layer that constitute a first principal surface and a second principal surface, respectively, where the first principal surface and the second principal surface are opposite to each other in the element assembly. The first magnetic layer has a higher relative magnetic permeability than the second magnetic layer. At least part of a winding portion of the coil conductor is located in the first magnetic layer. The first magnetic layer contains metal magnetic particles and a resin, and the second magnetic layer contains metal magnetic particles, a resin, and zinc oxide particles. The metal magnetic particles and the zinc oxide particles are dispersed in the resin.

20 Claims, 5 Drawing Sheets

(51) Int. Cl.

| | |
|---|---|
| ***H01F 27/29*** | (2006.01) |
| ***H01F 27/28*** | (2006.01) |
| ***H01F 3/10*** | (2006.01) |
| ***H01F 17/00*** | (2006.01) |
| *H01F 17/04* | (2006.01) |

(52) U.S. Cl.
CPC ..... *H01F 27/2823* (2013.01); *H01F 27/292* (2013.01); *H01F 27/327* (2013.01); *H01F 2003/106* (2013.01); *H01F 2017/0066* (2013.01); *H01F 2017/048* (2013.01)

(58) Field of Classification Search
CPC ..... H01F 27/2823; H01F 2017/0066; H01F 2017/048; H01F 2003/106; H01F 17/04
See application file for complete search history.

(56) References Cited

U.S. PATENT DOCUMENTS

| | | | | |
|---|---|---|---|---|
| 9,659,704 | B2 * | 5/2017 | Yang ..... | H01F 17/0013 |
| 2002/0097124 | A1 | 7/2002 | Inoue et al. | |
| 2009/0231077 | A1 * | 9/2009 | Liao ..... | H01F 17/04 336/177 |
| 2013/0249664 | A1 | 9/2013 | Tonoyama et al. | |
| 2016/0126004 | A1 | 5/2016 | Yang et al. | |

FOREIGN PATENT DOCUMENTS

| | | | |
|---|---|---|---|
| JP | 2009-302386 | A | 12/2009 |
| JP | 2016-009858 | A | 1/2016 |
| JP | 2016-092404 | A | 5/2016 |
| KR | 10-2005-0100714 | A | 10/2005 |
| KR | 10-2013-0109048 | A | 10/2013 |

OTHER PUBLICATIONS

An Office Action mailed by the Korean Intellectual Property Office dated Oct. 22, 2019, which corresponds to Korean Patent Application No. 10-2018-0158066 and is related to U.S. Appl. No. 16/180,943 with English language translation.

* cited by examiner

COIL COMPONENT

CROSS-REFERENCE TO RELATED APPLICATION

This application claims benefit of priority to Japanese Patent Application No. 2017-238859, filed Dec. 13, 2017, the entire content of which is incorporated herein by reference.

BACKGROUND

Technical Field

The present disclosure relates to a coil component.

Background Art

To date, coil components have been used as power inductors in DC/DC converter circuits and the like. In accordance with size reduction and an increase in current of electronic equipment in recent years, a corresponding size reduction and increase in current of power inductors has also been required. Therefore, a coil component that is suitable for high-current usage and that has excellent direct current superposition characteristics has been developed intensively.

Japanese Unexamined Patent Application Publication No. 2016-9858 discloses an electronic chip component including a magnetic main body in which an internal coil portion is embedded, wherein the magnetic main body includes a core layer including the internal coil portion and upper and lower cover layers disposed respectively on and under the core layer, and the core layer has a magnetic permeability different from the magnetic permeability of at least one of the upper and lower cover layers.

When a coil component is used for an apparatus through which a high current flows, there is a problem in that the coil component correspondingly generates heat. As a result, the coil component that is applied to a high-current usage is required to have excellent temperature characteristics, in which heat generation is suppressed, in addition to excellent direct current superposition characteristics.

SUMMARY

The present disclosure provides a coil component having excellent direct current superposition characteristics and excellent temperature characteristics.

The present inventors obtained a coil component having excellent direct current superposition characteristics and excellent temperature characteristics by adding zinc particles to a magnetic layer having a relatively low relative magnetic permeability in the coil component, and the present disclosure was realized.

According to preferred embodiments of the present disclosure, a coil component includes an element assembly and a coil conductor embedded in the element assembly. The element assembly includes a first magnetic layer and a second magnetic layer that constitute a first principal surface and a second principal surface, respectively, where the first principal surface and the second principal surface are opposite to each other in the element assembly. The first magnetic layer has a higher relative magnetic permeability than the second magnetic layer, and at least part of a winding portion of the coil conductor is located in the first magnetic layer. The first magnetic layer contains metal magnetic particles and a resin, and the second magnetic layer contains metal magnetic particles, a resin, and zinc oxide particles, with the metal magnetic particles and the zinc oxide particles being dispersed in the resin.

The coil component according to preferred embodiments of the present disclosure has the above-described features and, therefore, has excellent direct current superposition characteristics and excellent temperature characteristics.

Other features, elements, characteristics and advantages of the present disclosure will become more apparent from the following detailed description of preferred embodiments of the present disclosure with reference to the attached drawings.

DETAILED DESCRIPTION

Figure 1:
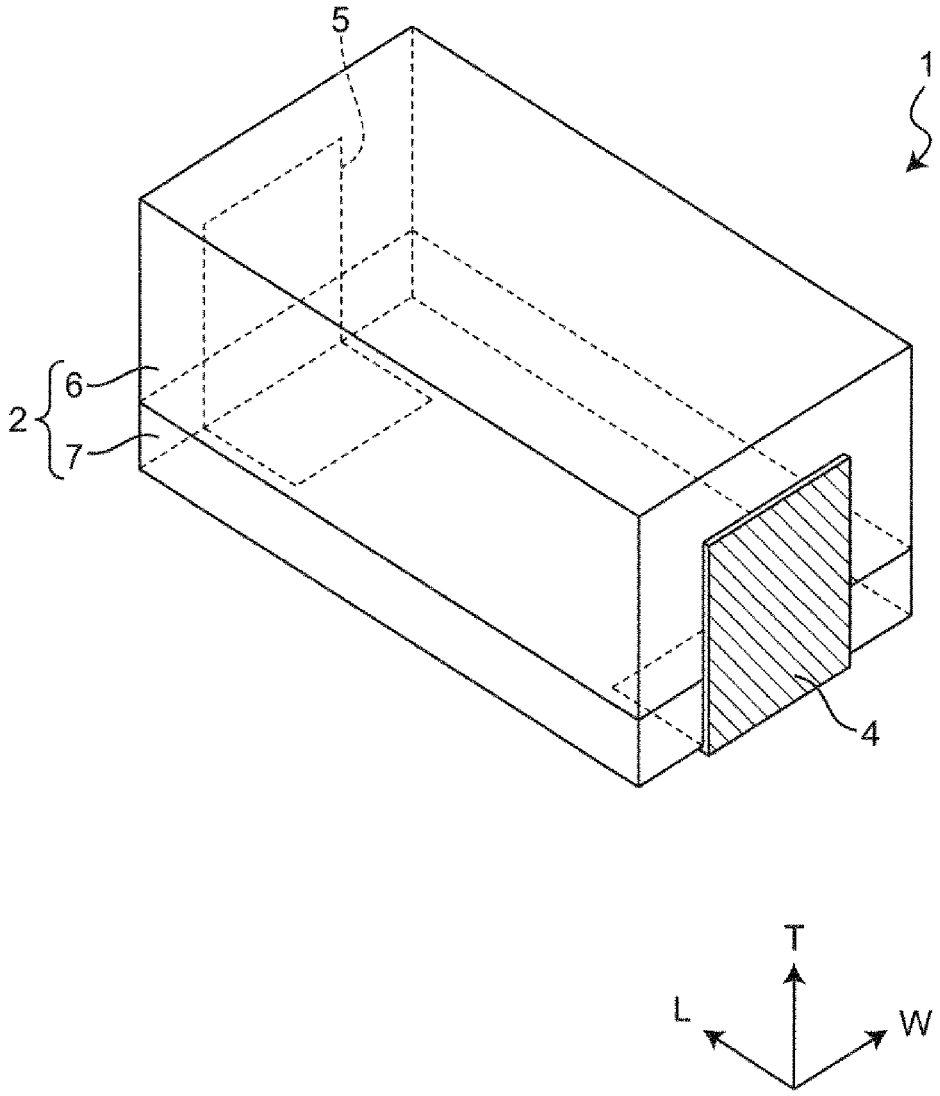
FIG. 1 is a schematic perspective view showing a coil component according to a first embodiment of the present disclosure.

The coil components according to embodiments of the present disclosure will be described below in detail with reference to the drawings. However, the shapes, the arrangements, and the like of the coil component and constituent elements according to the present disclosure are not limited to the embodiments described below or to the configurations shown in the drawings.

First Embodiment

Figure 2:
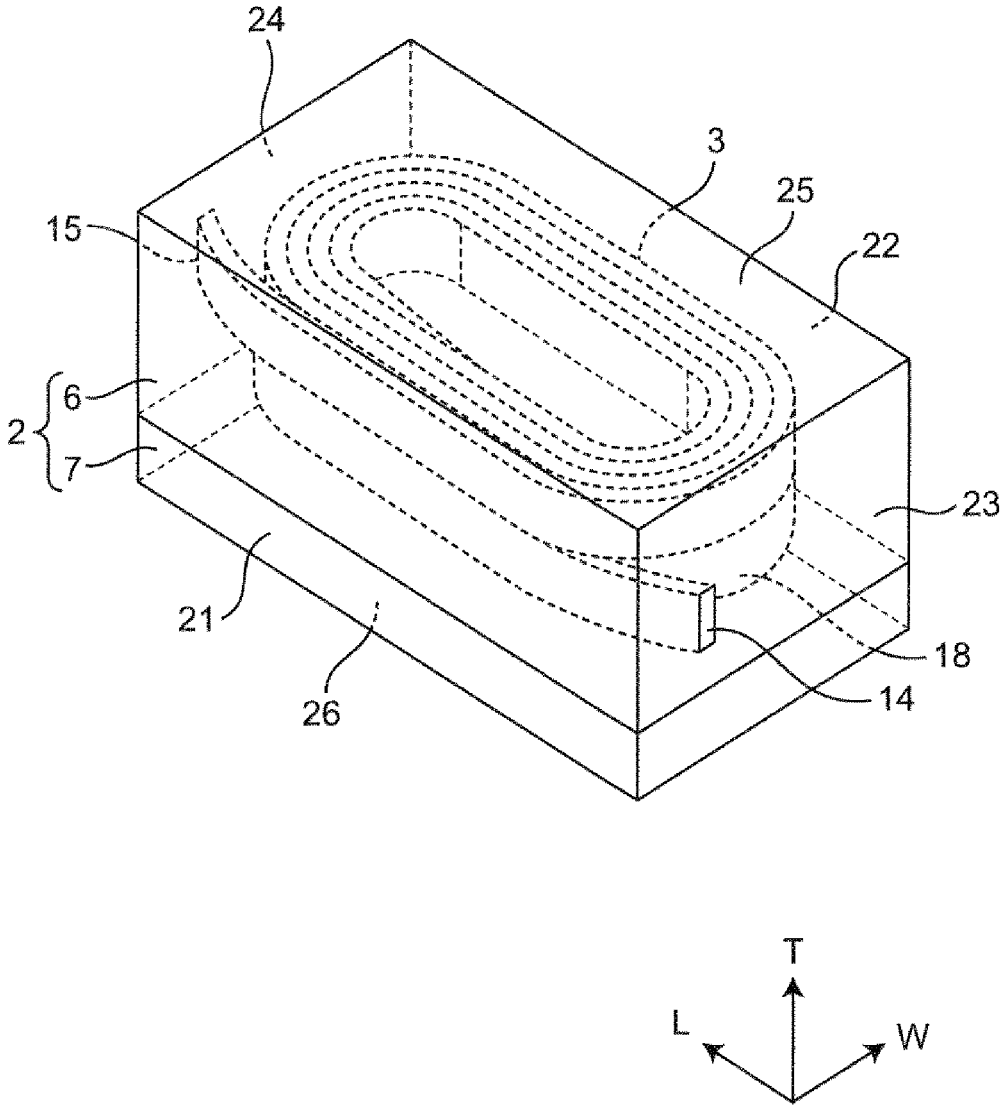
FIG. 2 is a perspective view of the coil component shown in FIG. 1, although outer electrodes are not shown.
Figure 3:
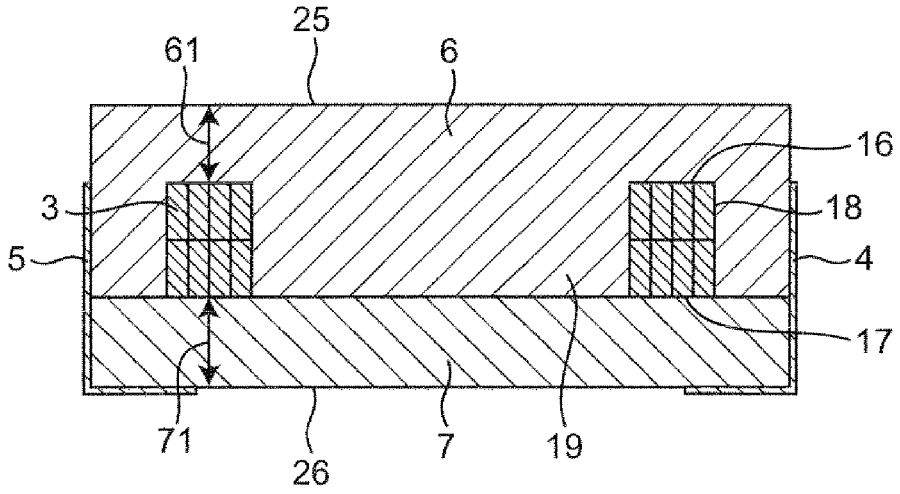
FIG. 3 is a schematic sectional view showing a cross section parallel to the LT-plane of the coil component shown in FIG. 1.

FIG. 1 is a schematic perspective view showing a coil component 1 according to a first embodiment of the present disclosure. FIG. 2 is a perspective view of an element assembly 2 of the coil component 1. FIG. 3 is a sectional view showing a cross section of the coil component 1.

As shown in FIGS. 1 to 3, the coil component 1 according to the present embodiment has a substantially rectangular parallelepiped shape and includes an element assembly 2 and a coil conductor 3 embedded in the element assembly 2, as shown in simple outline. The coil component 1 may further include a first outer electrode 4 and a second outer electrode 5. Regarding the element assembly 2 shown in FIG. 3, the right-side and left-side surfaces are referred to as "end surfaces", the upper-side surface is referred to as an "upper surface", the lower-side surface is referred to as a "lower surface", the near-side surface is referred to as a "front surface", and the far-side surface is referred to as a "back surface". The end surfaces, the front surface, and the back surface may also be referred to simply as "side surfaces". The element assembly 2 includes a first magnetic layer 6 located as an upper portion of the element assembly 2 and a second magnetic layer 7 located as a lower portion. The first magnetic layer 6 and the second magnetic layer 7 constitute a first principal surface and a second principal surface, respectively, where the first principal surface and the second principal surface are opposite to each other in the element assembly 2. In the configuration shown in FIGS. 1 to 3, the first principal surface of the element assembly 2 corresponds to an element assembly upper surface 25, and the second principal surface corresponds to an element assembly lower surface 26. A coil conductor 3 is embedded inside the element assembly 2. Regarding the coil conductor 3, the surface in the winding direction of the winding is referred to as a "side surface" of the coil conductor 3, and the surfaces in the thickness direction of the winding are referred to as "end surfaces" of the coil conductor 3. In the present embodiment, the surface that is formed by the principal surface of a rectangular wire serving as the outermost layer of the coil conductor 3 and that is parallel to the axis of the coil conductor 3 is a side surface 18, and the surfaces that are formed by the side surfaces of each rectangular wire layer and that are perpendicular to the axis of the coil conductor 3 are end surfaces 16 and 17. The first outer electrode 4 and the second outer electrode 5 are disposed on the surfaces (end surface 23 and end surface 24, respectively) of the element assembly 2. In the configuration shown in FIGS. 1 to 3, each of the first outer electrode 4 and the second outer electrode 5 extends over the surface of both the first magnetic layer 6 and the second magnetic layer 7, but may be disposed on the surface of any one of the first magnetic layer 6 and the second magnetic layer 7. In the configuration shown in FIGS. 1 to 3, the first outer electrode 4 and the second outer electrode 5 extend from the end surface 23 and end surface 24, respectively, of the element assembly 2 to part of the lower surface 26. That is, the first outer electrode 4 and the second outer electrode 5 are substantially L-shaped electrodes. However, in the coil component 1 according to the present embodiment, the shapes and the arrangements of the first outer electrode 4 and the second outer electrode 5 are not limited to those shown in FIGS. 1 and 3. The two ends (end 14 and end 15) of the coil conductor 3 are electrically connected to the first outer electrode 4 and the second outer electrode 5, respectively, on the end surfaces 23 and 24, respectively, of the element assembly 2.

In the present specification, the length of the coil component 1 is referred to as "L", the width is referred to as "W", and the thickness (height) is referred to as "T" (refer to FIG. 1 and FIG. 2). In the present specification, a plane parallel to a front surface 21 and a back surface 22 of the element assembly is referred to as an "LT-plane", a plane parallel to the end surfaces 23 and 24 is referred to as a "WT-plane", and a plane parallel to the upper surface 25 and the lower surface 26 is referred to as an "LW-plane".

As described above, the element assembly 2 includes the first magnetic layer 6 and the second magnetic layer 7 that constitute the first principal surface and the second principal surface, respectively, where the first principal surface and the second principal surface are opposite to each other in the element assembly 2. The first magnetic layer 6 has a higher relative magnetic permeability than the second magnetic layer 7. When the second magnetic layer 7 having a relatively low relative magnetic permeability is included in the element assembly 2, as described above, the density of the flux that passes inside the element assembly 2 can be decreased, and the direct current superposition characteristics of the coil component 1 can be improved. Meanwhile, the first magnetic layer 6 and the second magnetic layer 7 contain metal magnetic particles. Therefore, magnetic flux is generated when a current flows through the coil conductor 3, and an eddy current is generated in the metal magnetic particles due to the magnetic flux generated. The eddy current produces a loss due to heat, and heat may be generated in the magnetic layer. In this regard, the second magnetic layer 7 has a lower relative magnetic permeability than the first magnetic layer 6. Therefore, an eddy current loss is not readily produced in the second magnetic layer 7, and heat generation of the coil component 1 can be suppressed.

The difference between the relative magnetic permeability of the first magnetic layer 6 and the relative magnetic permeability of the second magnetic layer 7 is preferably about 20 or more. When the difference in the relative magnetic permeability is about 20 or more, the direct current superposition characteristics can be further improved.

First Magnetic Layer

The first magnetic layer 6 contains metal magnetic particles and a resin. The first magnetic layer 6 may be formed of a composite material composed of the metal magnetic particles and the resin. The relative magnetic permeability of the first magnetic layer 6 is about 15 or more, preferably about 20 or more, and more preferably about 30 or more.

There is no particular limitation regarding a metal magnetic material that constitutes the metal magnetic particles included in the first magnetic layer 6 as long as the metal magnetic material is a magnetic material. Examples of the metal magnetic material include iron, cobalt, nickel, and gadolinium and an alloy of at least one of these. Preferably, the metal magnetic material that constitutes the metal magnetic particles is iron or an iron alloy. Iron may be iron only or an iron derivative, e.g., a complex. There is no particular limitation regarding such an iron derivative, and examples of the iron derivative include iron carbonyl, which is a complex of iron and CO, preferably iron pentacarbonyl. In particular, hard grade iron carbonyl (for example, hard grade iron carbonyl produced by BASF) having an onion skin structure (structure in which concentric-sphere-shaped layers are formed around the center of a particle) is preferable. There is no particular limitation regarding the iron alloy, and example of the iron alloy include Fe-Si-based alloys, Fe-Si-Cr-based alloys, and Fe-Si-Al-based alloys. The above-described alloys may further contain B, C, and the like as other secondary components. There is no particular limitation regarding the content of the secondary component, and the content may be for example, about 0.1% by weight or more and 5.0% by weight or less (i.e., from about 0.1% by weight to 5.0% by weight), and preferably about 0.5% by weight or more and 3.0% by weight or less (i.e., from about 0.5% by weight to 3.0% by weight). The metal magnetic particles may be composed of only one of the above-described metal magnetic materials, or be composed of at least two metal magnetic materials.

Preferably, the metal magnetic particles included in the first magnetic layer 6 contain at least first metal magnetic particles and second metal magnetic particles. The first metal magnetic particles and the second metal magnetic particles are different from each other in at least the average particle diameter. The average particle diameter of the first metal magnetic particles is more than the average particle diameter of the second metal magnetic particles. The metal magnetic particles contain the first metal magnetic particles and the second metal magnetic particles having average particle diameters different from each other, and this may indicate that the metal magnetic particles included in the first magnetic layer 6 have bimodal particle size distribution. When the first magnetic layer 6 includes at least two types of metal magnetic particles having different average particle diameters, as described above, the filling ratio of the metal magnetic particles with respect to the first magnetic layer 6 can be increased and, thereby, magnetic characteristics of the first magnetic layer 6 can be improved. The metal magnetic particles included in the first magnetic layer 6 may contain only one type of metal magnetic particles or only two types of metal magnetic particles (only the first metal magnetic particles and the second metal magnetic particles). However, the metal magnetic particles included in the first magnetic layer 6 may further contain at least one type of other metal magnetic particles in addition to the first metal magnetic particles and the second metal magnetic particles.

In a preferred aspect, the first metal magnetic particles are preferably composed of an Fe-Si-Cr-based alloy, and the second metal magnetic particles are preferably composed of Fe. In this case, the magnetic permeability can be increased due to the Fe-Si-Cr-based alloy serving as the first metal magnetic particles and the superposition characteristics can be improved by increasing the saturation magnetic flux density due to Fe serving as the second metal magnetic particles. In a preferred aspect, the average particle diameter of the first metal magnetic particles is preferably about 10 μm or more and 70 μm or less (i.e., from about 10 μm to 70 μm), and more preferably about 20 μm or more and 50 μm or less (i.e., from about 20 μm to 50 μm). The average particle diameter of the second metal magnetic particles is preferably about 0.2 μm or more and 10 μm or less (i.e., from about 0.2 μm to 10 μm), and more preferably about 0.5 μm or more and 5 μm or less (i.e., from about 0.5 μm to 5 μm). When the average particle diameters of the first metal magnetic particles and the second metal magnetic particles fall within the above-described ranges, the metal magnetic particles can be easily handled, the filling ratio of the metal magnetic particles with respect to the first magnetic layer 6 can be further increased, and the magnetic characteristics of the first magnetic layer 6 can be further improved.

In the present specification, "average particle diameter" refers to an average equivalent circle diameter of particles in a SEM (scanning electron microscope) image of a cross section of the magnetic layer. For example, the average particle diameter of the above-described metal magnetic particles can be obtained by taking SEM photographs of a plurality of (for example, five) regions (for example, 130 μm×100 μm) in a cross section of the first magnetic layer 6 that is obtained by cutting the coil component 1, analyzing the resulting SEM images by using image analysis software (for example, Azokun (registered trademark) produced by Asahi Kasei Engineering Corporation) to determine the equivalent circle diameters of 500 or more of metal particles, and calculating the average thereof. In the case in which the first magnetic layer contains at least two types of metal magnetic particles having different average particle diameters, each of the average particle diameters of the metal magnetic particles can be determined by the procedure described below. For example, in the case in which the first magnetic layer contains two types of metal magnetic particles having different average particle diameters, when a histogram of determined equivalent circle diameters is formed, the result is a two-peak distribution. The diameter at the position of each peak is assumed to be the average particle diameter. In the case in which the peak heights are the same over a plurality of equivalent circle diameter ranges in the histogram, the average value of the equivalent circle diameters in the range is assumed to be the average particle diameter.

In a preferred aspect, the surface of each metal magnetic particle may be covered with a coating of an insulating material (hereafter also referred to simply as an "insulating coating"). In such an aspect, the surface of the metal magnetic particle may be covered with the insulating coating to the extent that the insulation performance between the particles can be enhanced. That is, part of the surface of the metal magnetic particle may be covered with the insulating coating or the entire surface of the metal magnetic particle may be covered. There is no particular limitation regarding the shape of the insulating coating, and the shape of a network or a layer may be adopted. In a preferred aspect, regarding each of the metal magnetic particles, about 30% or more, preferably about 60% or more, more preferably about 80% or more, further preferably about 90% or more, and particularly preferably 100% of the surface is covered with the insulating coating. The specific resistance of the inside of the magnetic layer can be increased by covering the surfaces of the metal magnetic particles with the insulating coating.

There is no particular limitation regarding the thickness of the insulating coating. The thickness may be preferably about 1 nm or more and 100 nm or less (i.e., from about 1 nm to 100 nm), more preferably 3 nm or more and 50 nm or less (i.e., from 3 nm to 50 nm), and further preferably 5 nm or more and 30 nm or less (i.e., from 5 nm to 30 nm), for example, about 10 nm or more and 30 nm or less (i.e., from about 10 nm to 30 nm) or about 5 nm or more and 20 nm or less (i.e., from about 5 nm to 20 nm). The specific resistance of the magnetic layer can be increased by increasing the thickness of the insulating coating. In addition, when the thickness of the insulating coating is decreased, the amount of the metal particles in the magnetic layer can be increased, the magnetic characteristics of the magnetic layer are improved, and size reduction of the magnetic layer is readily realized.

There is no particular limitation regarding the resin included in the first magnetic layer 6, and the resin may be a thermosetting resin, for example, an epoxy resin, a phenol resin, a polyester resin, a polyimide resin, or a polyolefin resin. The resin included in the first magnetic layer 6 may be only one type or be at least two types.

In the above-described aspect, the content of the metal magnetic particles in the first magnetic layer 6 may be preferably about 80% by weight or more, more preferably about 90% by weight or more, and further preferably about 95% by weight or more relative to the weight of the entire first magnetic layer 6. There is no particular limitation regarding the upper limit of the content of the metal magnetic particles in the first magnetic layer 6, and the content may be preferably about 98% by weight or less relative to the weight of the entire first magnetic layer 6.

The content of the resin in the first magnetic layer 6 is preferably about 1% by weight or more and 10% by weight or less (i.e., from about 1% by weight to 10% by weight), and more preferably about 2% by weight or more and 5% by weight or less (i.e., from about 2% by weight to 5% by weight) relative to the weight of the entire first magnetic layer 6. The filling ratio of the metal magnetic particles with respect to the first magnetic layer 6 may be preferably about 50% or more, more preferably about 65% or more, further preferably about 75% or more, and still further preferably about 85% or more. There is no particular limitation regarding the upper limit of the filling ratio of the metal magnetic particles with respect to the first magnetic layer 6, and the filling ratio may be about 98% or less, about 95% or less, about 90% or less, or about 80% or less. When the filling ratio of the metal particles with respect to the first magnetic layer 6 is increased, the relative magnetic permeability of the first magnetic layer 6 is increased, and higher inductance can be obtained.

In the present specification, the "filling ratio" refers to the proportion of the area of particles in a SEM image of a cross section of the magnetic layer. For example, the filling ratio of the metal magnetic particles with respect to the first magnetic layer 6 can be obtained by cutting the vicinity of the central portion of a product by using a wire saw (DWS3032-4 produced by Meiwafosis Co., Ltd.) so as to expose the substantially central portion of the LT plane of the coil component 1, subjecting the resulting cross section to ion milling (Ion Milling System IM 4000 produced by Hitachi High-Technologies Corporation) and removal of sagging so as to obtain a cross section for observation, taking SEM photographs of a plurality of (for example, five) regions (for example, 130 μm×100 μm) in a cross section of the first magnetic layer 6, and analyzing the resulting SEM images by using the image analysis software (for example, Azokun (registered trademark) produced by Asahi Kasei Engineering Corporation) to determine the proportion of the area of metal magnetic particles in the region.

In an aspect, the first magnetic layer 6 may further contain particles composed of a material other than the metal magnetic material. The fluidity during production of the first magnetic layer 6 can be adjusted by adding particles composed of the other material. For example, the first magnetic layer may further contain particles composed of a non-magnetic inorganic material. Examples of the non-magnetic inorganic material include an inorganic oxide, a non-magnetic ferrite material, and silica. Examples of the inorganic oxide include aluminum oxide (typically $Al_2O_3$) and silicon oxide (typically $SiO_2$). The non-magnetic ferrite material may be a complex oxide containing at least two metals selected from Zn, Cu, Mn, and Fe. When the first magnetic layer 6 contains a non-magnetic material, the flexural strength of the coil component 1 may be enhanced.

Second Magnetic Layer

The second magnetic layer 7 contains metal magnetic particles, a resin, and zinc oxide particles. The metal magnetic particles and the zinc oxide particles included in the second magnetic layer 7 are dispersed in the resin. The second magnetic layer 7 may be formed of a composite material composed of the metal magnetic particles, the resin, and the zinc oxide particles. The relative magnetic permeability of the second magnetic layer 7 is about 2 or more, preferably about 5 or more, and more preferably about 7 or more.

Zinc oxide has nonlinear I-V characteristics in which electric resistance is high and current barely flows at a predetermined voltage or less, but at above the predetermined voltage, electric resistance sharply decreases and characteristics close to electrical conductivity are exhibited. Consequently, at the predetermined voltage or less, heat generation due to flow of a current can be suppressed and the temperature characteristics of the coil component can be improved. As described above, the second magnetic layer 7 has a lower relative magnetic permeability than the first magnetic layer 6 and, therefore, the content of the metal magnetic particles in the second magnetic layer 7 can be less than the content of the metal magnetic particles in the first magnetic layer 6. As a result, the temperature characteristics of the coil component 1 can be improved by adding zinc oxide particles to the second magnetic layer 7 and, in addition, the inductance of the coil component 1 can be increased by increasing the content of the metal magnetic particles in the first magnetic layer 6 that makes a large contribution to the magnetic characteristics of the coil component 1. Meanwhile, zinc oxide can facilitate formation of a protective film, described later.

Preferably, the average particle diameter of the zinc oxide particles is less than the average particle diameter of the second metal magnetic particles. When the average particle diameter of the zinc oxide particles is decreased, the surface area of the zinc oxide particles is increased, and the heat dissipation effect is improved. As a result, the temperature characteristics of the coil component 1 can be further improved. In addition, when the average particle diameter of the zinc oxide particles is decreased, the filling ratio of the metal magnetic particles with respect to the second magnetic layer 7 can be increased, and the relative magnetic permeability of the second magnetic layer 7 can be increased. It is preferable that the shapes of the zinc oxide particles be substantially spherical. When substantially spherical zinc oxide particles are used, the temperature characteristics of the coil component 1 can be further improved, and the relative magnetic permeability of the second magnetic layer 7 can be further increased.

The average particle diameter of the zinc oxide particles is preferably about 0.1 μm or more and 1 μm or less (i.e., from about 0.1 μm to 1 μm). When the average particle diameter falls within the above-described range, the temperature characteristics of the coil component 1 can be further improved.

The content of the zinc oxide particles in the second magnetic layer 7 is preferably about 10% by weight or more and 30% by weight or less (i.e., from about 10% by weight to 30% by weight) relative to the weight of the entire second magnetic layer 7. When the content of the zinc oxide particles falls within the above-described range, compatibility between high relative magnetic permeability and excellent temperature characteristics can be ensured. In addition, when the content of the zinc oxide particles falls within the above-described range, formation of a protective film described later can be facilitated.

The metal magnetic particles included in the second magnetic layer 7 may be composed of the same material as the material constituting the metal magnetic particles in the first magnetic layer 6. The metal magnetic particles included in the second magnetic layer 7 may have the same composition as at least one type of the metal magnetic particles included in the first magnetic layer 6, or have a different composition.

The metal magnetic particles included in the second magnetic layer 7 may contain at least third metal magnetic particles. The metal magnetic particles included in the second magnetic layer 7 may contain only one type of metal magnetic particles (only the third metal magnetic particles), but may further contain at least one type of other metal magnetic particles in addition to the third metal magnetic particles.

The third metal magnetic particles are preferably particles composed of an Fe-Si-Cr-based alloy or Fe. The magnetic permeability can be increased by using the third metal magnetic particles composed of the Fe-Si-Cr-based alloy. The superposition characteristics can be improved by using the third metal magnetic particles composed of Fe.

The average particle diameter of the third metal magnetic particles is preferably about 0.2 μm or more and 20 μm or less (i.e., from about 0.2 μm to 20 μm), and more preferably about 1 μm or more and 10 μm or less (i.e., from about 1 μm to 10 μm). When the average particle diameter of the third metal magnetic particles falls within the above-described range, handling is easy, and the relative magnetic permeability of the second magnetic layer 7 can be set within an appropriate range.

Preferably, the average particle diameter of the third metal magnetic particles is less than the average particle diameter of the first metal magnetic particles and is more than or equal to the average particle diameter of the second metal magnetic particles. When the average particle diameter of the third metal magnetic particles falls within the above-described range, handling is easy, and the relative magnetic permeability of the second magnetic layer 7 can be set within an appropriate range.

Preferably, the average particle diameter of the third metal magnetic particles is more than the average particle diameter of the second metal magnetic particles. In this case, a higher relative magnetic permeability can be obtained. Specifically, the average particle diameter of the third metal magnetic particles is preferably more than 5 μm or more, and the average particle diameter of the second metal magnetic particles is preferably less than 5 μm. When the average particle diameters of the second metal magnetic particles and the third metal magnetic particles fall within the above-described ranges, a higher relative magnetic permeability can be obtained.

In the above-described aspect, the content of the metal magnetic particles in the second magnetic layer 7 may be preferably about 45% by weight or more, more preferably about 50% by weight or more, and further preferably about 55% by weight or more relative to the weight of the entire second magnetic layer 7. The content of the metal magnetic particles in the second magnetic layer 7 may be preferably about 86% by weight or less, more preferably 82% by weight or less, and further preferably 78% by weight or less relative to the weight of the entire second magnetic layer 7.

There is no particular limitation regarding the resin included in the second magnetic layer 7, and the resin may be the same as the resin included in the first magnetic layer 6. The resin included in the second magnetic layer 7 may have the same composition as the resin included in the first magnetic layer 6, or have a different composition. Preferably, the resin included in the second magnetic layer 7 has the same composition as the resin included in the first magnetic layer 6. When the first magnetic layer 6 and the second magnetic layer 7 contain the same resin, the adhesiveness between the first magnetic layer 6 and the second magnetic layer 7 can be improved.

The content of the resin in the second magnetic layer 7 relative to the weight of the entire second magnetic layer 7 is preferably more than the content of the resin in the first magnetic layer 6 relative to the weight of the entire first magnetic layer 6. In this case, the strength of the coil component 1 can be enhanced. The content of the resin in the second magnetic layer 7 is preferably about 4% by weight or more and 12% by weight or less (i.e., from about 4% by weight to 12% by weight) relative to the weight of the entire second magnetic layer 7. When the content of the resin falls within the above-described range, the strength of the coil component 1 can be enhanced. The difference between the content of the resin in the second magnetic layer 7 relative to the entire weight of the second magnetic layer 7 and the content of the resin in the first magnetic layer 6 relative to the weight of the entire first magnetic layer 6 is preferably about 1% by weight or more and 8% by weight or less (i.e., from about 1% by weight to 8% by weight). When the content of the resin falls within the above-described range, the strength of the coil component 1 can be enhanced.

The first magnetic layer 6 and the second magnetic layer 7 contain metal magnetic particles. Therefore, magnetic flux is generated when a current flows through the coil conductor 3, and an eddy current is generated in the metal magnetic particles due to the magnetic flux generated. The eddy current produces a loss due to heat, and heat may be generated in the magnetic layer. In this regard, the second magnetic layer 7 has a lower relative magnetic permeability than the first magnetic layer 6. Therefore, an eddy current loss is not easily produced in the second magnetic layer 7, and heat generation of the coil component 1 can be suppressed.

The filling ratio of the metal magnetic particles with respect to the second magnetic layer 7 may be preferably about 10% or more, more preferably about 20% or more, and further preferably about 30% or more. The filling ratio of the metal magnetic particles with respect to the second magnetic layer 7 may be preferably about 70% or less, more preferably about 60% or less, and further preferably about 50% or less.

In an aspect, the second magnetic layer 7 may further contain particles composed of a material other than the metal magnetic material in the same manner as the first magnetic layer 6. For example, the second magnetic layer 7 may contain magnetic ferrite particles, $SiO_2$ particles, and/or $Al_2O_3$ particles. The $SiO_2$ particles serve as a bulking agent (filler) and provide an insulating property. The $Al_2O_3$ particles have high thermal conductivity and function to improve temperature characteristics. It is preferable that the shapes of these particles be substantially spherical. When the particles are substantially spherical, the filling ratio of the metal magnetic particles with respect to the second magnetic layer 7 can be increased, and the relative magnetic permeability of the second magnetic layer 7 can be increased. Meanwhile, the average particle diameter of the particles is preferably 0.1 μm or more and 1 μm or less (i.e., from 0.1 μm to 1 μm). When the average particle diameter falls within the above-described range, the filling ratio of the metal magnetic particles with respect to the second magnetic layer 7 can be increased, and the relative magnetic permeability of the second magnetic layer 7 can be increased.

The element assembly 2 includes the first magnetic layer 6 and the second magnetic layer 7, and the coil conductor 3 is embedded in the element assembly 2. When the element assembly 2 includes the second magnetic layer 7 having a relatively low relative magnetic permeability, the density of the flux that passes inside the element assembly 2 can be decreased, and the direct current superposition characteristics can be improved.

In the coil component 1 according to the present embodiment, as shown in FIGS. 1 to 3, the second magnetic layer 7 is arranged so as to cover the entire end surface 17 of the coil conductor 3. In such a configuration, the second magnetic layer 7 is arranged so as to block a magnetic path from a core portion of the coil conductor 3. When the second magnetic layer 7 is arranged so as to block an inside magnetic path of the coil conductor 3, as described above, the second magnetic layer 7 having a relatively low relative magnetic permeability can be arranged on the cavity, which tends to be saturated with magnetic flux, of the coil conductor 3, and the direct current superposition characteristics can be improved. In addition, the second magnetic layer 7 is arranged so as to be in contact with the entire end surface 17 of the coil conductor 3 and, therefore, magnetic paths around the conductor wire constituting the coil conductor 3 can be blocked. As a result, the direct current superposition characteristics of the coil component 1 can be improved. In this regard, the "core portion" refers to a portion inside the coil conductor 3, that is, a portion surrounded by the coil conductor 3. In the coil component 1 according to the present embodiment, the core portion is filled with part of the first magnetic layer 6.

In the coil component 1 according to the present embodiment, at least part of a winding portion of the coil conductor 3 is located in the first magnetic layer 6. In the configuration shown in FIGS. 1 to 3, the coil conductor 3 is arranged such that the axis points in a vertical direction of the element assembly 2. The two ends 14 and 15 of the coil conductor 3 extend to the end surfaces 23 and 24, respectively, of the element assembly 2 and are electrically connected to the first outer electrode 4 and the second outer electrode 5, respectively. However, the two ends 14 and 15 of the coil conductor 3 may extend to the upper surface 25 of the element assembly, or extend to the lower surface 26 of the element assembly. In this regard, in the present embodiment, the entire winding portion of the coil conductor 3 is located in the first magnetic layer 6, but the winding portion of the coil conductor 3 may be located in both the first magnetic layer 6 and the second magnetic layer 7.

There is no particular limitation regarding the electrically conductive material constituting the coil conductor 3, and examples of the electrically conductive material include gold, silver, copper, palladium, and nickel. Preferably, the electrically conductive material is copper. The coil conductor 3 may contain only one electrically conductive material or at least two electrically conductive materials.

The coil conductor 3 can be formed by using a conductor wire or a conductive paste, but it is preferable that the coil conductor 3 be formed by using the conductor wire because the direct current resistance of the coil component can be reduced. The conductor wire may be a substantially round or rectangular wire, but is preferably a substantially rectangular wire. When the substantially rectangular wire is used, the conductor wire can be readily wound with no gap.

In an aspect, the conductor wire constituting the coil conductor 3 may be covered with an insulating material. When the conductor wire constituting the coil conductor 3 is covered with an insulating material, insulation between the coil conductor 3 and the magnetic layers (first magnetic layer 6 and second magnetic layer 7) can be further ensured. As a matter of course, the insulating material is not present on portions to be connected to the first outer electrode 4 and second outer electrode 5 of the conductor wire (that is, two ends 14 and 15 of the coil conductor 3), and the wire is exposed.

There is no particular limitation regarding the insulating material that covers the conductor wire constituting the coil conductor 3, and examples of the insulating material include a polyurethane resin, a polyester resin, an epoxy resin, and a polyamide imide resin. The polyamide imide resin is preferable.

Any type of coil conductor can be used as the coil conductor 3 and, for example, a coil conductor of α-winding, edgewise winding, spiral winding, helical winding, or the like can be used. When the coil conductor 3 is formed by using a conductor wire, α-winding or edgewise winding is preferable from the viewpoint of size reduction of the component.

In an aspect, as shown in FIG. 2, the coil conductor 3 may be a coil conductor of α-winding. In such an aspect, the second magnetic layer 7 is arranged parallel to a winding plane, for example, perpendicularly to the axis of the coil conductor 3 in FIG. 2. When the coil conductor 3 and the second magnetic layer 7 are arranged as described above, the magnetic path generated perpendicularly to the winding plane can be efficiently blocked, and the direct current superposition characteristics can be improved. In this regard, the "winding plane" refers to a plane on which the conductor wire is wound and to a plane perpendicular to the drawing in FIG. 3. In the case in which the coil conductor 3 is formed by using a substantially rectangular wire, the winding plane may be a plane on which the substantially rectangular wire is arrayed in the thickness direction.

In a preferred aspect, the coil conductor 3 may be a coil conductor of a substantially rectangular wire subjected to α-winding. In such an aspect, the second magnetic layer 7 is arranged substantially perpendicularly to the width direction of the substantially rectangular wire (vertical direction of the drawing in FIG. 3). In this regard, "substantially perpendicular" refers to not only "precisely perpendicular" but also "inclined at some angle with respect to a perpendicular direction for a reason in production". For example, "substantially perpendicular" may be "at an angle of about 60° or more and 120° or less (i.e., from about 60° to 120°), and preferably 80° or more and 100° or less (i.e., from 80° to 100°)". When the second magnetic layer 7 is arranged substantially perpendicularly to the width direction of the substantially rectangular wire, as described above, the magnetic paths around the substantially rectangular wire can be cut, and the direct current superposition characteristics can be further improved.

In an aspect, the coil conductor 3 may be a coil conductor of edgewise winding. In such an aspect, the second magnetic layer 7 is arranged so as to come into surface contact with the principal surface of the conductor wire constituting the coil conductor 3 on the end surface of the coil conductor 3. When the second magnetic layer 7 and the coil conductor 3 are in surface contact with each other, the heat dissipation effect of the coil component 1 is enhanced.

The thickness of the first magnetic layer 6 on the upper surface of the winding portion of the coil conductor 3 (denoted by reference numeral 61 in FIG. 3) is preferably more than the thickness of the second magnetic layer 7 (denoted by reference numeral 71 in FIG. 3). In this case, the relative magnetic permeability of the entire coil component 1 can be further increased. The thicknesses of the first magnetic layer 6 and the second magnetic layer 7 may be obtained by taking SEM photographs of a cross section of the element assembly 2 that is obtained by cutting the coil component 1 and calculating the average value of the thicknesses measured at a plurality of (for example, five) places. More preferably, the thickness of the first magnetic layer 6 on the upper surface of the winding portion of the coil conductor 3 is more than about 1.0 times and less than about 3.0 times (i.e., from about 1.0 times to about 3.0 times) the thickness of the second magnetic layer 7. When the thicknesses of the first magnetic layer 6 and the second magnetic layer 7 fall within the above-described range, the relative magnetic permeability can be further increased.

In the above-described configuration example, there is no particular limitation regarding the thickness of the first magnetic layer 6, and the thickness may be, for example, about 90 μm or more. When the thickness of the first magnetic layer 6 is increased, the inductance of the coil component 1 can be further increased. Meanwhile, there is no particular limitation regarding the thickness of the first magnetic layer 6, and the thickness may be, for example, about 270 μm or less. When the thickness of the first magnetic layer 6 is decreased, the density of the flux that passes through the upper portion of the coil can be decreased, and the direct current superposition characteristics can be improved. There is no particular limitation regarding the thickness of the second magnetic layer 7, and the thickness may be, for example, about 90 μm or more. When the thickness of the second magnetic layer 7 is increased, the direct current superposition characteristics of the coil component 1 can be further improved. Meanwhile, there is no particular limitation regarding the thickness of the second magnetic layer 7, and the thickness may be, for example, about 250 μm or less. When the thickness of the second magnetic layer 7 is decreased, the inductance of the coil component 1 can be further increased.

In another configuration example, the thickness of the second magnetic layer 7 may be more than the thickness of the first magnetic layer 6 on the upper surface of the winding portion of the coil conductor 3. In this case, the temperature characteristics of the coil component 1 can be further improved. The thickness of the second magnetic layer 7 is preferably more than about 1.0 times and less than about 1.2 times (i.e., from about 1.0 times to about 1.2 times) the thickness of the first magnetic layer 6 on the upper surface of the winding portion of the coil conductor 3. When the thicknesses of the first magnetic layer 6 and the second magnetic layer 7 fall within the above-described range, the temperature characteristics of the coil component 1 can be further improved.

In another aspect described above, there is no particular limitation regarding the thickness of the first magnetic layer 6, and the thickness may be, for example, about 50 μm or more and 250 μm or less (i.e., from about 50 μm to 250 μm). There is no particular limitation regarding the thickness of the second magnetic layer 7, and the thickness may be, for example, 50 μm or more and 300 μm or less (i.e., from 50 μm to 300 μm).

Outer Electrode

The first outer electrode 4 and the second outer electrode 5 are formed at predetermined locations on the surface of the element assembly 2 so as to be electrically connected to the ends 14 and 15, respectively, of the coil conductor 3.

In an aspect, as shown in FIG. 1 and FIG. 3, the first outer electrode 4 and the second outer electrode 5 are disposed as substantially L-shaped electrodes (two-surface electrodes) on the end surface 23 and end surface 24, respectively, of the element assembly 2 of the coil component 1 and part of the lower surface 26. In another aspect, each of the first outer electrode 4 and the second outer electrode 5 may be a bottom surface electrode disposed on only part of the lower surface 26 of the coil component 1. When the outer electrodes are disposed as the L-shaped electrodes or the bottom surface electrodes, an occurrence of short circuit with other components, e.g., a casing and a shield, located above can be suppressed during mounting of the coil component 1 on a substrate or the like.

In another aspect, the first outer electrode 4 and the second outer electrode 5 may be disposed as a five-surface electrode on the end surface 23 and end surface 24, respectively, and at least part of each of the front surface 21, the back surface 22, the upper surface 25, and the lower surface 26 of the element assembly 2 of the coil component 1.

In another aspect, the first outer electrode 4 and the second outer electrode 5 are disposed as substantially L-shaped electrodes (two-surface electrodes) on the end surface 23 and end surface 24, respectively, of the element assembly 2 of the coil component 1 and part of the upper surface 25. In another aspect, each of the first outer electrode 4 and the second outer electrode 5 may be an upper surface electrode disposed on only part of the upper surface 25 of the coil component 1.

Each of the first outer electrode 4 and the second outer electrode 5 is composed of a conductive material, preferably at least one metal material selected from Au, Ag, Pd, Ni, Sn, and Cu. Each of the first outer electrode 4 and the second outer electrode 5 may be a single layer or a multilayer. In an aspect, in the case in which the outer electrode is a multilayer, the outer electrode may include a layer containing Ag or Pd, a layer containing Ni, or a layer containing Sn. In a preferred aspect, the outer electrode is composed of a layer containing Ag or Pd, a layer containing Ni, and a layer containing Sn. Preferably, the above-described layers are disposed in the order of the layer containing Ag or Pd, the layer containing Ni, and the layer containing Sn from the coil conductor side. Preferably, the layer containing Ag or Pd is a layer in which a Ag paste or a Pd paste is baked (that is, a thermally hardened layer), and the layer containing Ni and the layer containing Sn may be plating layers. There is no particular limitation regarding the thickness of the outer electrodes 4 and 5, and the thickness may be, for example, 1 μm or more and 20 μm or less (i.e., from 1 μm to 20 μm), and preferably 5 μm or more and 10 μm or less (i.e., from 5 μm to 10 μm).

The coil component 1, except the first outer electrode 4 and the second outer electrode 5, according to the present embodiment may be covered with an insulating protective layer (not shown in the drawing). When the protective layer is disposed, an occurrence of short circuit with other electronic components can be suppressed during mounting on a substrate or the like.

Examples of the insulating material constituting the protective layer include resin materials, e.g., acrylic resins, epoxy resins, and polyimide resins, which have high electrical insulating properties. The protective layer may contain the above-described resin material and cations of elements constituting metal magnetic particles included in the element assembly 2.

Figure 4A:
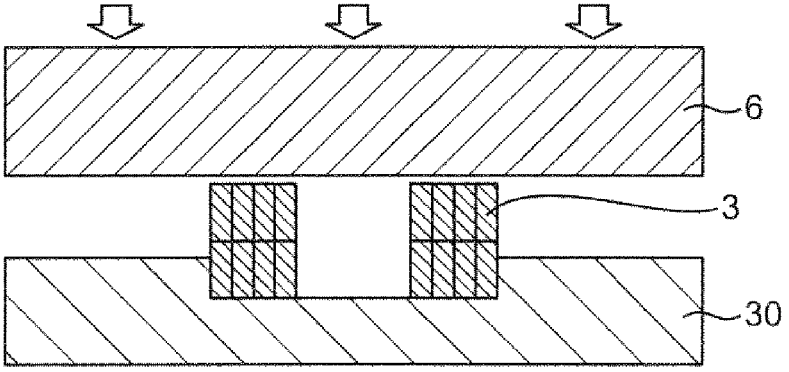
FIGS. 4A to 4C are diagrams illustrating a method for manufacturing the coil component according to the first embodiment of the present disclosure.
Figure 4B:
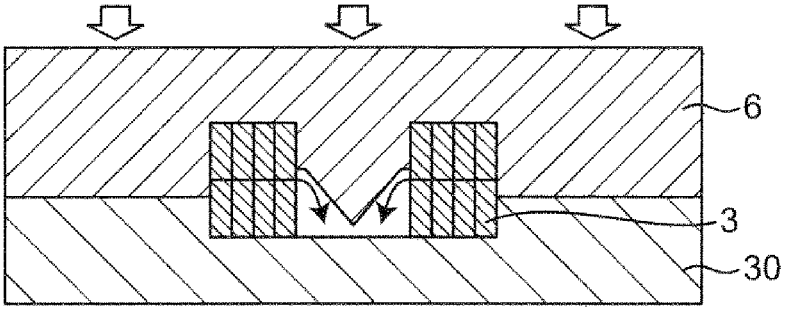
Figure 4C:
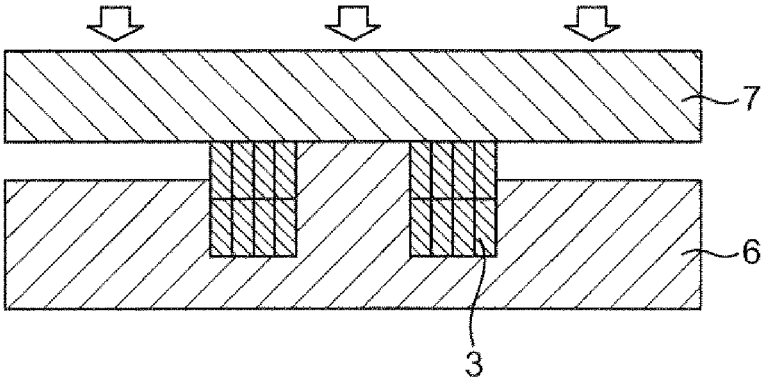

Next, a method for manufacturing the coil component 1 will be described below with reference to FIGS. 4A to 4C. A plurality of coil conductors 3 are placed in a mold 30. a sheet of the first magnetic layer 6 is placed on these coil conductors 3, and a primary press is performed (FIG. 4A). At least part of each coil conductor 3 is embedded into the above-described sheet, and part of the first magnetic layer 6 is added inside the coil conductor 3 by the primary press (FIG. 4B).

The sheet into which the coil conductors 3 are embedded by the primary press is removed from the mold. A sheet of the second magnetic layer 7 is placed on the surface at which the coil conductors 3 are exposed, and a secondary press is performed (FIG. 4C). In this manner, a collective coil substrate including a plurality of element assemblies is obtained. The above-described two sheets are integrated by the secondary press so as to form the element assembly 2 of the coil component 1. In this regard, a collective coil substrate may be obtained by placing a sheet of the second magnetic layer 7 on the coil conductors 3, performing a first press, placing a sheet of the first magnetic layer 6 on the surface at which the coil conductors 3 are exposed, and performing a second press.

The collective coil substrate obtained by the secondary press is cut by a dicer or the like so as to be divided into the individual element assemblies 2. The ends 14 and 15 of the coil conductor 3 are exposed at the end surfaces 23 and 24, respectively, where the first principal surface and the second principal surface are opposite to each other of the resulting element assembly 2.

The first outer electrode 4 and the second outer electrode 5 are formed at predetermined locations on the element assembly 2 by, for example, plating treatment, preferably electroplating treatment.

In a preferred aspect, the plating treatment is performed after the surface of the element assembly 2 is irradiated with laser in accordance with the locations at which the outer electrodes are formed. When the surface of the element assembly 2 is irradiated with laser, at least part of the resin component constituting the element assembly 2 is removed so as to expose the metal magnetic particles. Consequently, the electric resistance of the surface of the element assembly 2 is reduced, and plating is readily formed. In the coil component 1 according to the present embodiment, the second magnetic layer 7 tends to have lower relative magnetic permeability and lower content of metal magnetic particles than the first magnetic layer 6. When the content of the metal magnetic particles is low, the electric resistance of the surface of the element assembly is not readily reduced by irradiating the surface of the element assembly with laser, and formation of the outer electrode by plating tends to be difficult. On the other hand, in the present embodiment, the electric resistance of the surface can be reduced by laser irradiation in spite of a relatively low content of the metal magnetic particles in the second magnetic layer 7. The reason for this is conjectured to be that the second magnetic layer 7 contains zinc oxide particles. Therefore, in the coil component 1 according to the present embodiment, regarding both the surface of the first magnetic layer 6 having high relative magnetic permeability and relatively high content of metal magnetic particles and the surface of the second magnetic layer 7 having low relative magnetic permeability and relatively low content of metal magnetic particles, formation of plating is easy, and the outer electrodes can be formed by plating. For example, as shown in FIG. 1 and FIG. 3, each of the first outer electrode 4 and the second outer electrode 5 can be formed so as to extend over both the surface of the first magnetic layer 6 and the surface of the second magnetic layer 7. Further, as described above, the second magnetic layer 7 has a relatively low content of metal magnetic particles and, therefore, extension of plating beyond the second magnetic layer 7 can be suppressed.

In an aspect, an insulating protective layer may be formed on the surface of the coil component 1, except the first outer electrode 4 and the second outer electrode 5. The protective layer may be formed on the surface of the coil component 1 after the outer electrodes are formed, or the outer electrodes may be formed after the protective layer is formed on the element assembly 2 before being provided with the outer electrodes.

There is no particular limitation regarding a method for forming the protective layer, and a known method can be appropriately adopted. For example, the protective layer can be formed by preparing a resin emulsion containing an etching component that ionizes a metal constituting the metal magnetic particles included in the element assembly 2, an anionic surfactant, and a resin component, applying the resulting resin emulsion to the coil component 1 after being provided with the outer electrodes or the element assembly 2 before being provided with the outer electrodes, and performing drying. In the above-described method, when the resin emulsion is applied to the coil component 1 or the element assembly 2, the metal, for example, Fe, constituting the metal magnetic particles included in the element assembly is ionized by the etching agent. The ionized cationic element is eluted into the resin emulsion and reacts with the resin component. As a result, the resin component in the resin emulsion is neutralized and is settled on the surface of the element assembly 2. Consequently, the surface of the element assembly 2 is covered with the protective layer. In the case in which the protective layer is formed on the element assembly 2 before being provided with the outer electrodes, the coil conductor 3 exposed at the surface of the element assembly 2 is not readily ionized because of being composed of an element, for example, Cu, that is nobler than Fe. Therefore, the protective layer is not formed on the end of the coil conductor 3 exposed at the surface of the element assembly 2. Likewise, in the case in which the protective layer is formed on the coil component 1 after being provided with the outer electrodes, the outer electrodes are not readily ionized because of being composed of an element nobler than Fe. Therefore, the protective layer is not formed on the surfaces of the outer electrodes. As described above, the second magnetic layer 7 tends to have a relatively low content of metal magnetic particles. If the content of metal magnetic particles is low, the amount of Fe ions eluted is decreased, and the protective layer is not readily formed. On the other hand, in the present embodiment, the second magnetic layer 7 can be readily provided with the protective layer in spite of the low content of metal magnetic particles. The reason for this is configured to be that the second magnetic layer 7 contains zinc oxide particles. Consequently, in the coil component 1 according to the present embodiment, the protective layer can be readily formed on both surfaces of the first magnetic layer 6 and the second magnetic layer 7 constituting the element assembly 2.

In this manner, the coil component 1 according to the present embodiment is produced. In this regard, the method for manufacturing the coil component according to the present embodiment is not limited to the above-described method, and production can be performed by a method in which part of the above-described method is modified or by another method.

Second Embodiment

Figure 5:
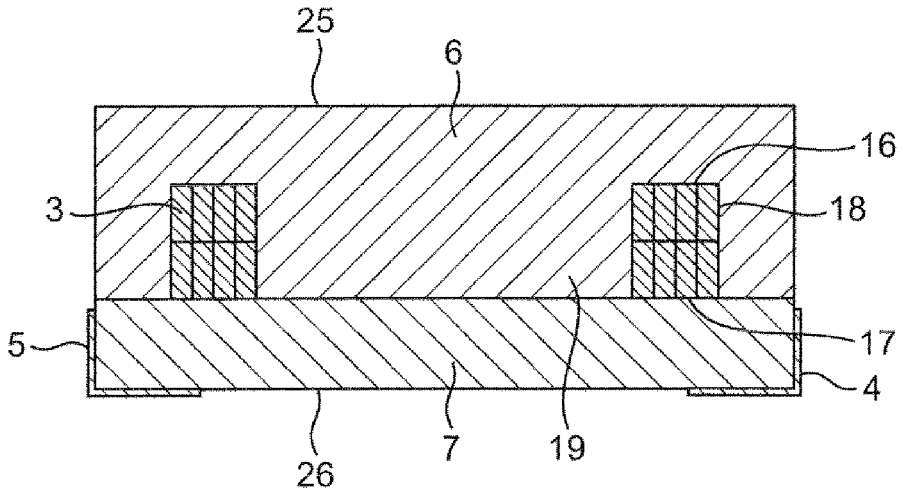
FIG. 5 is a schematic sectional view showing a cross section parallel to the LT-plane of the coil component according to a second embodiment of the present disclosure.

FIG. 5 is a sectional view showing a cross section parallel to the LT-plane of a coil component according to a second embodiment of the present disclosure. The coil component according to the second embodiment is different from the coil component according to the first embodiment in that the first outer electrode 4 and the second outer electrode 5 are arranged at locations different from the locations in the first embodiment. Differences in the configuration will be described below. In the coil component according to the second embodiment, the same configurations as in the coil component according to the first embodiment are indicated by the same reference numerals as those set forth above and explanations thereof will not be provided. The coil component according to the second embodiment have excellent direct current superposition characteristics and excellent temperature characteristics in the same manner as the coil component according to the first embodiment.

The coil component 1 according to the present embodiment further includes a first outer electrode 4 and a second outer electrode 5, and the first outer electrode 4 and the second outer electrode 5 are disposed on the surface of the second magnetic layer 7 and are electrically connected to one end and the other end, respectively, of the coil conductor 3. One end and the other end of the coil conductor 3 may extend to end surfaces 23 and 24, respectively, composed of the second magnetic layer 7 of the element assembly 2 and be connected to the first outer electrode 4 and the second outer electrode 5, respectively, on the end surfaces 23 and 24. Alternatively, one end and the other end of the coil conductor 3 may extend to a lower surface 26 composed of the second magnetic layer 7 of the element assembly 2 and be connected to the first outer electrode 4 and the second outer electrode 5, respectively, on the lower surface 26. There is no particular limitation regarding the shapes of the first outer electrode 4 and the second outer electrode 5, and the outer electrodes may be substantially L-shaped electrodes as shown in FIG. 5 or five-surface electrodes. When the outer electrodes are disposed on the second magnetic layer having excellent temperature characteristics compared with the first magnetic layer 6, the extension portions of the coil conductor 3 pass through the second magnetic layer and, as a result, the temperature characteristics of the coil component 1 can be further improved.

Third Embodiment

Figure 6:
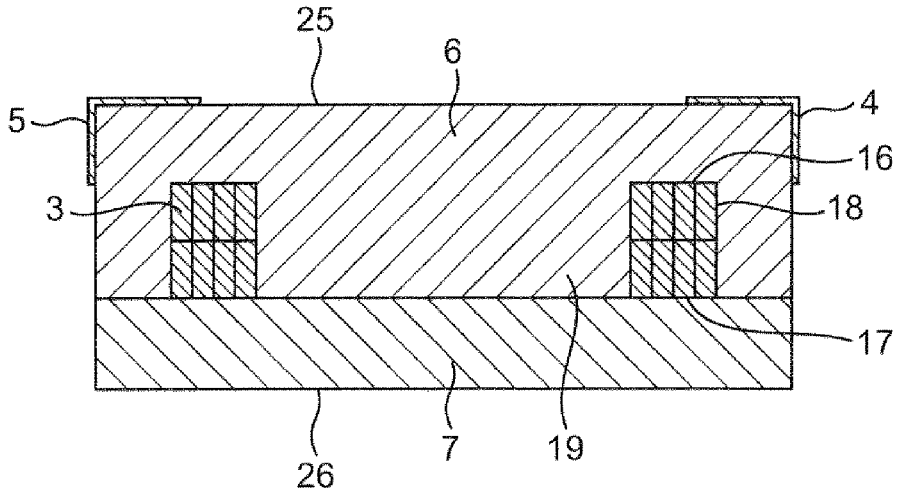
FIG. 6 is a schematic sectional view showing a cross section parallel to the LT-plane of the coil component according to a third embodiment of the present disclosure.

FIG. 6 is a sectional view showing a cross section parallel to the LT-plane of a coil component according to a third embodiment of the present disclosure. The coil component according to the third embodiment is different from the coil component according to the first embodiment in that the first outer electrode 4 and the second outer electrode 5 are arranged at locations different from the locations in the first embodiment. Differences in the configuration will be described below. In the coil component according to the third embodiment, the same configurations as in the coil component according to the first embodiment are indicated by the same reference numerals as those set forth above and explanations thereof will not be provided. The coil component according to the third embodiment have excellent direct current superposition characteristics and excellent temperature characteristics in the same manner as the coil component according to the first embodiment.

The coil component 1 according to the present embodiment further includes a first outer electrode 4 and a second outer electrode 5, and the first outer electrode 4 and the second outer electrode 5 are disposed on the surface of the first magnetic layer 6 and are electrically connected to one end and the other end, respectively, of the coil conductor 3. One end and the other end of the coil conductor 3 may extend to end surfaces 23 and 24, respectively, composed of the first magnetic layer 6 of the element assembly 2 and be connected to the first outer electrode 4 and the second outer electrode 5, respectively, on the end surfaces 23 and 24. Alternatively, one end and the other end of the coil conductor 3 may extend to an upper surface 25 composed of the first magnetic layer 6 of the element assembly 2 and be connected to the first outer electrode 4 and the second outer electrode 5, respectively, on the upper surface 25. There is no particular limitation regarding the shapes of the first outer electrode 4 and the second outer electrode 5, and the outer electrodes may be substantially L-shaped electrodes as shown in FIG. 6 or five-surface electrodes. When the outer electrodes are disposed on the first magnetic layer having high relative magnetic permeability compared with the second magnetic layer 7, the inductance of the coil component 1 can be further increased.

The coil components according to the first embodiment, the second embodiment, and the third embodiment of the present disclosure are as described above. However, the present disclosure is not limited to the above-described embodiments, and the design may be changed within the scope of the present disclosure. For example, in the coil component 1 according to the above-described embodiment, each of the first magnetic layer 6 and the second magnetic layer 7 is composed of a single layer. However, at least one of the first magnetic layer 6 and the second magnetic layer 7 may be a multilayer body in which a plurality of magnetic sheets are stacked.

The present disclosure includes the following aspects but is not limited to these aspects.

Aspect 1

A coil component including an element assembly and a coil conductor embedded in the element assembly. The element assembly includes a first magnetic layer and a second magnetic layer that constitute a first principal surface and a second principal surface, respectively, where the first principal surface and the second principal surface are opposite to each other in the element assembly. The first magnetic layer has a higher relative magnetic permeability than the second magnetic layer. At least part of a winding portion of the coil conductor is located in the first magnetic layer. The first magnetic layer contains metal magnetic particles and a resin, and the second magnetic layer contains metal magnetic particles, a resin, and zinc oxide particles, with the metal magnetic particles and the zinc oxide particles being dispersed in the resin.

Aspect 2

The coil component according to aspect 1, wherein the metal magnetic particles included in the first magnetic layer contain at least first metal magnetic particles and second metal magnetic particles, and the average particle diameter of the first metal magnetic particles is more than the average particle diameter of the second metal magnetic particles.

Aspect 3

The coil component according to aspect 2, wherein the metal magnetic particles included in the second magnetic layer contain at least third metal magnetic particles. The average particle diameter of the third metal magnetic particles is less than the average particle diameter of the first metal magnetic particles and more than or equal to the average particle diameter of the second metal magnetic particles, and the average particle diameter of the zinc oxide particles is less than the average particle diameter of the second metal magnetic particles.

Aspect 4

The coil component according to aspect 3, wherein the average particle diameter of the third metal magnetic particles is more than the average particle diameter of the second metal magnetic particles.

Aspect 5

The coil component according to aspect 4, wherein the average particle diameter of the third metal magnetic particles is about 5 μm or more, and the average particle diameter of the second metal magnetic particles is less than about 5 μm.

Aspect 6

The coil component according to any one of aspects 1 to 5, wherein the average particle diameter of the zinc oxide particles is about 0.1 μm or more and about 1 μm or less (i.e., from about 0.1 μm to about 1 μm).

Aspect 7

The coil component according to any one of aspects 1 to 6, wherein the content of the zinc oxide particles in the second magnetic layer is about 10% by weight or more and about 30% by weight or less (i.e., from about 10% by weight to about 30% by weight) relative to the weight of the entire second magnetic layer.

Aspect 8

The coil component according to any one of aspects 1 to 7, wherein the content of the resin in the second magnetic layer relative to the entire weight of the second magnetic layer is more than the content of the resin in the first magnetic layer relative to the weight of the entire first magnetic layer.

Aspect 9

The coil component according to aspect 8, wherein the content of the resin in the second magnetic layer is about 4% by weight or more and about 12% by weight or less (i.e., from about 4% by weight to about 12% by weight) relative to the weight of the entire second magnetic layer.

Aspect 10

The coil component according to aspect 8 or aspect 9, wherein the difference between the content of the resin in the second magnetic layer relative to the entire weight of the second magnetic layer and the content of the resin in the first magnetic layer relative to the weight of the entire first magnetic layer is about 1% by weight or more and about 8% by weight or less (i.e., from about 1% by weight to about 8% by weight).

Aspect 11

The coil component according to any one of aspects 1 to 10, wherein the difference between the relative magnetic permeability of the first magnetic layer and the relative magnetic permeability of the second magnetic layer is about 20 or more.\

Aspect 12

The coil component according to any one of aspects 1 to 11, wherein the thickness of the first magnetic layer on the upper surface of the winding portion of the coil conductor is more than the thickness of the second magnetic layer.

Aspect 13

The coil component according to aspect 12, wherein the thickness of the first magnetic layer on the upper surface of the winding portion of the coil conductor is more than about 1.0 times and less than about 3.0 times (.e., from about 1.0 times to about 3.0 times) the thickness of the second magnetic layer.

Aspect 14

The coil component according to any one of aspects 1 to 11, wherein the thickness of the second magnetic layer is more than the thickness of the first magnetic layer on the upper surface of the winding portion of the coil conductor.

Aspect 15

The coil component according to aspect 14, wherein the thickness of the second magnetic layer is more than about 1.0 times and less than about 1.2 times (i.e., from about 1.0 times to about 1.2 times) the thickness of the first magnetic layer on the upper surface of the winding portion of the coil conductor.

Aspect 16

The coil component according to any one of aspects 1 to 15, wherein the coil component further includes a first outer electrode and a second outer electrode, and the first outer electrode and the second outer electrode are disposed on the surface of the second magnetic layer and are electrically connected to one end and the other end, respectively, of the coil conductor.

Aspect 17

The coil component according to any one of aspects 1 to 15, wherein the coil component further includes a first outer electrode and a second outer electrode, and the first outer electrode and the second outer electrode are disposed on the surface of the first magnetic layer and are electrically connected to one end and the other end, respectively, of the coil conductor.

The coil component according to the present disclosure can be widely applied as an inductor and the like to various applications.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element assembly; and a coil conductor embedded in the element assembly, wherein the element assembly includes a first magnetic layer and a second magnetic layer that constitute a first principal surface and a second principal surface, respectively, where the first principal surface and the second principal surface are opposite to each other in the element assembly, the first magnetic layer has a higher relative magnetic permeability than the second magnetic layer, at least part of a winding portion of the coil conductor is located in the first magnetic layer, the first magnetic layer contains metal magnetic particles and a resin, and the second magnetic layer contains metal magnetic particles, a resin, and spherical zinc oxide particles, the metal magnetic particles and the zinc oxide particles being dispersed in the resin.

2. The coil component according to claim 1, wherein the metal magnetic particles included in the first magnetic layer contain at least first metal magnetic particles and second metal magnetic particles, and the average particle diameter of the first metal magnetic particles is more than the average particle diameter of the second metal magnetic particles.

3. The coil component according to claim 2, wherein the metal magnetic particles included in the second magnetic layer contain at least third metal magnetic particles, the average particle diameter of the third metal magnetic particles is less than the average particle diameter of the first metal magnetic particles and more than or equal to the average particle diameter of the second metal magnetic particles, and the average particle diameter of the zinc oxide particles is less than the average particle diameter of the second metal magnetic particles.

4. The coil component according to claim 3, wherein the average particle diameter of the third metal magnetic particles is more than the average particle diameter of the second metal magnetic particles.

5. The coil component according to claim 4, wherein the average particle diameter of the third metal magnetic particles is 5 μm or more, and the average particle diameter of the second metal magnetic particles is less than 5 μm.

6. The coil component according to claim 1, wherein the average particle diameter of the zinc oxide particles is from 0.1 μm to 1 μm.

7. The coil component according to claim 1,
wherein a content of the zinc oxide particles in the second magnetic layer is from 10% by weight to 30% by weight relative to the weight of the entire second magnetic layer.

8. The coil component according to claim 1,
wherein a content of the resin in the second magnetic layer relative to the entire weight of the second magnetic layer is more than a content of the resin in the first magnetic layer relative to the weight of the entire first magnetic layer.

9. The coil component according to claim 8,
wherein the content of the resin in the second magnetic layer is from 4% by weight to 12% by weight relative to the weight of the entire second magnetic layer.

10. The coil component according to claim 8,
wherein a difference between the content of the resin in the second magnetic layer relative to the entire weight of the second magnetic layer and the content of the resin in the first magnetic layer relative to the weight of the entire first magnetic layer is from 1% by weight to 8% by weight.

11. The coil component according to claim 1,
wherein a difference between the relative magnetic permeability of the first magnetic layer and the relative magnetic permeability of the second magnetic layer is 20 or more.

12. The coil component according to claim 1,
wherein a thickness of the first magnetic layer on the upper surface of the winding portion of the coil conductor is more than a thickness of the second magnetic layer.

13. The coil component according to claim 12,
wherein the thickness of the first magnetic layer on the upper surface of the winding portion of the coil conductor is from 1.0 times to 3.0 times the thickness of the second magnetic layer.

14. The coil component according to claim 1,
wherein a thickness of the second magnetic layer is more than a thickness of the first magnetic layer on the upper surface of the winding portion of the coil conductor.

15. The coil component according to claim 14,
wherein the thickness of the second magnetic layer is from 1.0 times to 1.2 times the thickness of the first magnetic layer on the upper surface of the winding portion of the coil conductor.

16. The coil component according to claim 1, wherein
the coil component further includes a first outer electrode and a second outer electrode, and
the first outer electrode and the second outer electrode are disposed on the surface of the second magnetic layer and are electrically connected to one end and the other end, respectively, of the coil conductor.

17. The coil component according to claim 1, wherein
the coil component further includes a first outer electrode and a second outer electrode, and
the first outer electrode and the second outer electrode are disposed on the surface of the first magnetic layer and are electrically connected to one end and the other end, respectively, of the coil conductor.

18. The coil component according to claim 2,
wherein the average particle diameter of the zinc oxide particles is from 0.1 μm to 1 μm.

19. The coil component according to claim 2,
wherein a content of the zinc oxide particles in the second magnetic layer is from 10% by weight to 30% by weight relative to the weight of the entire second magnetic layer.

20. The coil component according to claim 2,
wherein a content of the resin in the second magnetic layer relative to the entire weight of the second magnetic layer is more than a content of the resin in the first magnetic layer relative to the weight of the entire first magnetic layer.

* * * * *